United States Patent [19]

Bleuel

[11] 4,364,673

[45] Dec. 21, 1982

[54] ELECTRIC CLOCK, PARTICULARLY A QUARTZ CLOCK

[75] Inventor: Walter Bleuel, Hofheim, Fed. Rep. of Germany

[73] Assignee: VDO Adolf Schindling AG, Frankfurt am Main, Fed. Rep. of Germany

[21] Appl. No.: 227,839

[22] Filed: Jan. 23, 1981

[30] Foreign Application Priority Data

Feb. 21, 1980 [DE] Fed. Rep. of Germany ..... 3006503

[51] Int. Cl.[3] ..... G04B 37/00

[52] U.S. Cl. ..... 368/316; 248/116

[58] Field of Search ..... 368/10, 276–278, 368/316–318; 248/114–116

[56] References Cited

U.S. PATENT DOCUMENTS 2,030,487 2/1936 Whitehead ..... 368/317

4,179,877 12/1979 Wilson et al. ..... 368/316

FOREIGN PATENT DOCUMENTS 599086 6/1924 Fed. Rep. of Germany ..... 368/316

2124861 11/1972 Fed. Rep. of Germany ..... 368/316

2054274 2/1981 United Kingdom ..... 368/316

*Primary Examiner*—Vit W. Miska

*Attorney, Agent, or Firm*—Martin A. Farber

[57] ABSTRACT

An electrical clock, particularly a quartz clock, with a movement case receiving a time-producing and time-indicating device, on the rear side of the movement case setting members being provided for the clock time and for an alarm device, and a mount in which the movement case is insertable in different relative positions relative to the mount. A viewing glass covers the time-indicating device. The movement case with the viewing glass form a self-contained unit. The mount is formed as a housing surrounding on all sides at least the rear side of the movement case and has an inner periphery which corresponds to the periphery of the movement case, the movement case being detachably catchably insertable within the inner periphery of the housing. The housing is formed at its outer periphery for connection to attachment means. The setting means accessible from the outside of said housing are mounted in the housing, said setting means, when the movement case is inserted in the housing, being operatively connected, in all relative positions of the movement case in the housing, with the setting member of the alarm device.

19 Claims, 5 Drawing Figures

FIG. 3
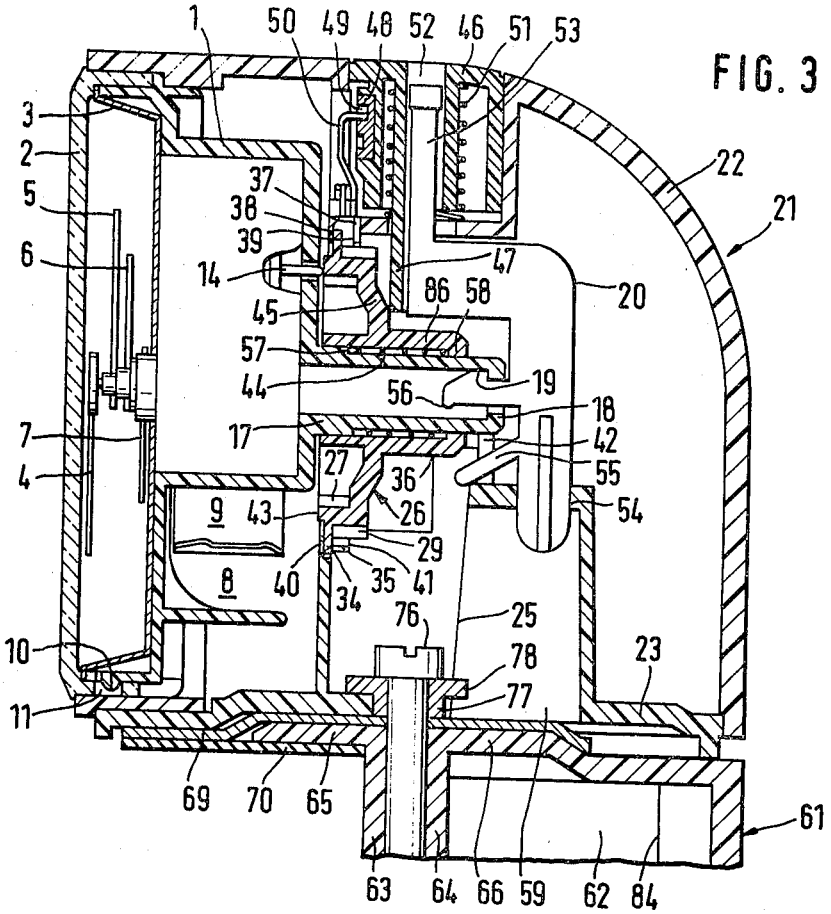
FIG. 4
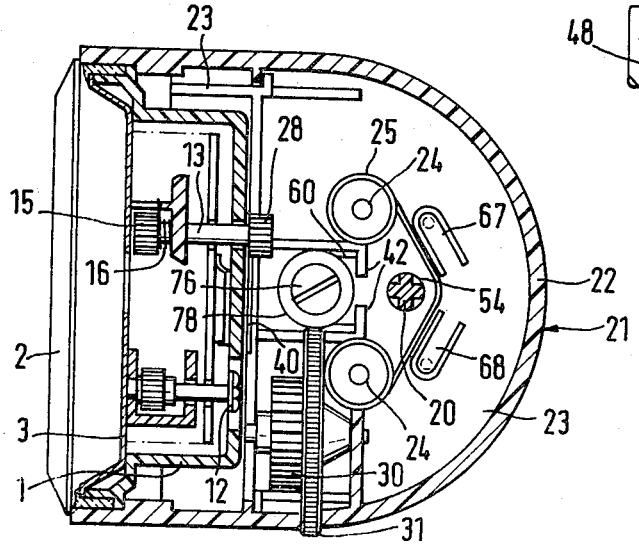
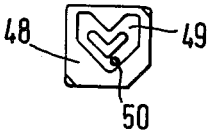
FIG. 5

ELECTRIC CLOCK, PARTICULARLY A QUARTZ CLOCK

The invention relates to an electrical clock, particularly a quartz clock, with a movement case receiving the time-producing and time-indicating means, on the rear side of the movement case setting members being provided for the clock time and for the alarm device, and a mount in which the movement case is insertable in different relative positions relative to the mount.

With one known clock of this type (German OS 25 31 747), the movement case is seated in a mount which comprises two parts which are swingable relative to each other about a common axis. The movement case is held in the mount by the viewing pane which is insertable catching in the mount. In such a clock, on the one hand the inclination of the dial to the surface on which it rests can be changed and on the other hand, after removal of the viewing pane or glass, the clock can be arranged to be turned through 90° in the dial plane, whereby the overall aesthetic impression given by the clock can be changed. Although this clock permits a greater change in the position of the dial with respect to the surface on which the clock is placed, the possibilities for change in position are still very limited. Also, for certain changes in position of the dial with respect to the mount parts of the clock must be taken apart and then these parts assembled again, which is a rather cumbersome procedure.

A clock of this type is already known (German GM 74 39 428), in which the rearward part of the movement case is formed like a ball and rests in a mount with a calotte-shaped receptor. The mount and the clock housing (movement case) are connected with one another by means of a screw which passes through an elongated slot which is present in the receptor and ends in a corresponding threaded bore in the housing. After releasing the screw the movement case can be swung in the mount in a plane by about 45 angular degrees and can be fixed by tightening the screw in the respective position at the time. Such a clock has the disadvantage that a change in the position of the movement case in the mount is not possible without the help of a tool. Moreover, the position change of the movement case in the mount is limited to the course or shape of the elongated slot, and consequently to a single plane of movement.

Both known clocks moreover beyond that have the common disadvantage that on the mount in no case are means provided for fastening the same to an object, as for example, a wall, a bookcase, a room divider or other objects or devices which greatly reduce the useability of the known clocks.

It is an object of the present invention to avoid these disadvantages.

It is thus, an object of the invention to create a clock with which the mount and the movement case of the clock can be brought into the most different relative positions with respect to one another, such that the movement case of the clock can be brought into an easily readable position of use in the most different positions of the mount. Moreover, the measures which are required for the realization of this object should be as inexpensive as possible and lead to a simple, construction of the mount and of the movement case which are advantageous in production.

Also, the movement case and the mount should be conceived such that clocks may be produced with a special aesthetic overall impression.

This objective is achieved in accordance with the invention in the manner that the movement case (1) with the viewing glass (2) which covers the time-indicating means (4,5,6) forms a self-contained unit of polygonal or circular contour, that the holder is developed in the form of a housing (21) which surrounds on all sides at least the rear side of the movement case and has an inner periphery which corresponds to the periphery of the movement case and within which the movement case (1) can be detachably engaged, that the housing (21) is developed at its outer periphery for connection to attachment means (61), and that setting means (31, 46, 53) accessible from the outside are mounted in the housing (21), said setting means when the movement case (1) has been inserted in the housing (21), being operatively connected, in all relative positions of both with respect to each other, with the setting members (13, 14) of the alarm device.

By these measures, the result is obtained that the dial can be turned 360° with respect to the housing and can thus be brought into an easily read position of use in every position of the housing. The complete covering of the rear of the movement case and its various setting members by the housing furthermore makes it possible for the clock to be mounted in the most different positions to use; the overall aesthetic effect, contrary to the known clocks, is not impaired in the case of the clock of the invention by the ordinarily unattractive back of the clock movement with its setting members. The provision of merely two setting possibilities—start-setting knob and setting wheel for the alarm device—which can even be reduced to only one setting possibility, namely a start-stop-setting knob, if one dispenses with the setting of the alarm time without removal of the movement case, furthermore makes it possible to effect the shaping of the housing within wide limits and solely on basis of aesthetic factors. This constitutes a particular advantage of the present invention. Another particular advantage of the invention is that the clock can also be used without the housing; it can therefore be removed from the housing, which is fixed in place, and taken along into another room. It is also possible to manufacture different styles of housing for one shape of the movement case, so as to be able to combine them with the movement case as the buyer wishes. In this way, a large number of different types of clocks can be produced with the investment of an extremely small amount of capital. The movement case containing the clock movement can namely then be manufactured economically in large quantities, while the relatively cheap housings are produced in the correspondingly smaller quantities, entirely aside from the fact that the cost of keeping in stock can be reduced considerably by such a division between movement case and housing.

In accordance with one advantageous embodiment of the invention, a pinion (28) is seated on the end of the setting shaft (13) which protrudes from the movement case (1) for the setting of the alarm time, said pinion meshing with an inner toothing (27) of a gear wheel (26) which is mounted in the housing (21) concentrically to the movement case receiver and the outer toothing (29) of which is functionally connected with a setting wheel (31) which protrudes beyond the periphery of the housing. With such a drive with a so-called sun wheel assurance is had that the drive is fully functional in every angular position of the movement case in the housing.

For the actuating of the start-stop switch of the alarm device it is preferable to provide in the housing (21) a setting knob (46) which can be displaced axially from a first position into a second position and is connected via a wedge friction drive (45, 47) with the start-stop pin (14) of the alarm device, which protrudes from the case movement (1). In accordance with one particularly advantageous embodiment, the gear wheel (26) which is present in the housing (21) for the setting of the alarm time is mounted for axial displacement against the force of a spring (44) and forms that part of the wedge transmission (45, 47) which is connected with the alarm device. In this embodiment, therefore, the sun wheel assumes two functions, namely on the one hand the function of a gear wheel between the setting wheel which protrudes beyond the periphery of the housing and the pinion which is seated on the alarm-time setting shaft and on the other hand the function of a part of the wedge transmission via which the start-stop pin of the alarm device can be actuated. Since upon actuation of the setting knob which extends out of the housing, the entire sun wheel is in each case displaced axially towards or away from the start-stop pin, assurance is provided with this embodiment also that in every angular position of the movement case with respect to the housing the start-stop pin can be actuated by the setting knob via the sun wheel.

The wedge transmission is advisedly developed in the manner that the gear wheel (26) has an end surface (45) which is at least partially conical in cross section and cooperates as a wedge friction drive with the free end (47) of the setting knob (46). In the same way, it is also in itself possible to develop the free end of the setting knob in the form of a wedge and allow it to act against the wedge-less gear wheel, but in that case the wedge cooperates with the toothed periphery of the gear wheel, which leads to increased wear of the two parts.

For a construction of the housing which is as simple and easy to manufacture as possible, it has proven advisable to support the gear wheel (26) at its outer periphery in the housing (21), rather than on a shaft, as is customarily the case with gear wheels. Such a mounting of the sun wheel on its outer periphery furthermore permits a particularly simple attachment of the movement case in the housing, as will be further described below. The mounting can be effected in advantageous fashion in the manner that the gear wheel (26) has a collar (34) which extends radially beyond the outer toothing (29) and is rotatably mounted between two housing parts (22, 23). Such a mounting has considerable advantages with respect to manufacture as compared with another embodiment which is also possible, in which the sun gear is supported by three pinions arranged fixed in position 120° apart in the housing.

In accordance with one advantageous embodiment of the invention, the movement case (1) is provided on its rear with a central tubular extension (17) which passes through a central opening in the gear wheel (26). In the housing there is a locking element (20) which is displaceable against the force of a restoring spring (55) and a hook (19) of which extends into the tubular extension (17) and engages behind the inner collar (18). This securing of the case movement in the housing by means of a central tubular extension on the movement case has the advantage that the outside dimension of the housing, at least in the plane of the dial, need only be slightly larger than the corresponding outside dimension of the movement case.

The locking element (20) is, particularly advantageously mounted coaxially in the setting knob and terminates below the operating stroke of the setting knob (46) in such a manner that upon actuation of the setting knob (46) the locking element (20) remains unactuated. By depressing the locking element, for instance by a ball point pen introduced into a guide channel for the locking element which is formed in the setting knob, the lock can be opened and the case removed from the housing in order to change the battery or set the clock time. In itself it is also possible to arrange the locking element at another place in the housing, but this has the disadvantage that the housing would have to be provided with another opening for the actuating element, which would have an unfavorable effect on the overall aesthetic appearance of the clock.

For manufacturing reasons it has proven advisable to form the reset spring (55) on the locking element (20). The reset spring can in this case be developed as a spring leg which protrudes obliquely from the locking element and rests against a projection on the housing.

In order to prevent unintentional turning of the movement case in the housing when the movement case is circular, it is advisable to provide notches and projections on the outer periphery of the movement case and the inner periphery of the housing (21), respectively, said notches and projections engaging with each other when the case (1) is inserted in the housing (21) and in this way preventing relative turning.

In accordance with a further concept of the invention, one side of the housing (21) is formed as a base (23) with an opening (59, 60) into which a clamping device (61) can be inserted with detachable engagement, turnable relative to the housing (21). In this way the usefulness of the clock can be considerably increased, since with such a mounting there is the possibility of using the clock not only in combination with a flat standing surface but also in combination with any edges, frames, bars, posts and other objects to which the mount and thus the clock can be clamped. In this way furthermore the readability of the clock is improved since now the housing can be directed better towards the viewer than is true in case of the presence merely of openings in the housing for fastening means, such as screws or hooks.

For the present purpose the most different types of clamping devices can in themselves be used. Thus it is possible to use clamping devices having two spring clamping jaws which extend approximately with axes parallel to each other, as well as clamping devices which have two spring-loaded clamping jaws which are turnable around a common pin, each forming a handle grip at one end. In particular, for aesthetic reasons it is advisable, however, to use a clamping device (61) which comprises a fixed clamping plate (65) and a movable clamping body (71) which is supported for longitudinal displacement but secured against rotation on a guide (62) fastened to the clamping plate (65), said clamping body being provided on its outer periphery with a thread (72) which cooperates with a corresponding thread (73) of a rotary body (74) which is rotatably supported on the guide (62). The guide advantageously comprises a tubular part (62) which has a wall (63) with two slots (82, 83) parallel to each other for guiding the movable clamping body (71) and a rail (84) which is axially parallel to the guide path and engages in a recess (85) in the clamping body (71) for securing the clamping body (71) against rotation as well as means for the mounting of the rotary body (74). In the case of a housing having a base surface which is circular or semi-circular, the tubular part will have a semi-circular cross section which is adapted in its dimensions to those of the surface of the base. In this way a particularly aesthetic effect of the clock provided with the clamping device is obtained.

In a preferred embodiment, a sleeve (64) is provided on the inner wall of the tubular part (62) to receive a threaded bolt (76) whose head is developed for insertion by detachable detent engagement into the opening (59, 60) in the base of the housing and on the free end of which a nut (75) can be screwed, resting against the end of the sleeve and serving for the rotatable mounting of the rotary body (74). Such an embodiment has the advantage that it consists of a particularly small number of parts and accordingly can be produced at low cost.

The invention will be described in further detail with reference to the drawings which contain illustrative embodiments shown in part diagrammatically, where in the drawings:

FIG. 3 is a cross section through the clock of FIG. 1 along the line III—III;

FIG. 4 is a cross section through the clock of FIG. 2 along the line IV—IV, and

FIG. 5 shows a detail of the setting knob of the alarm device.

Figure 1:
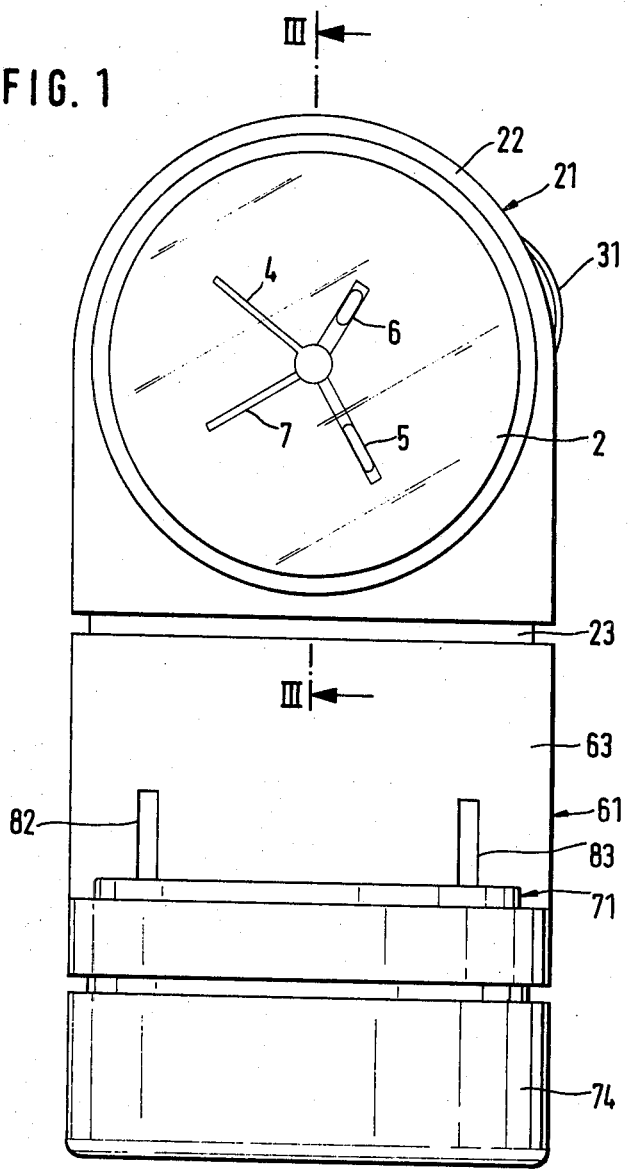
FIG. 1 is a front view of the clock.
Figure 2:
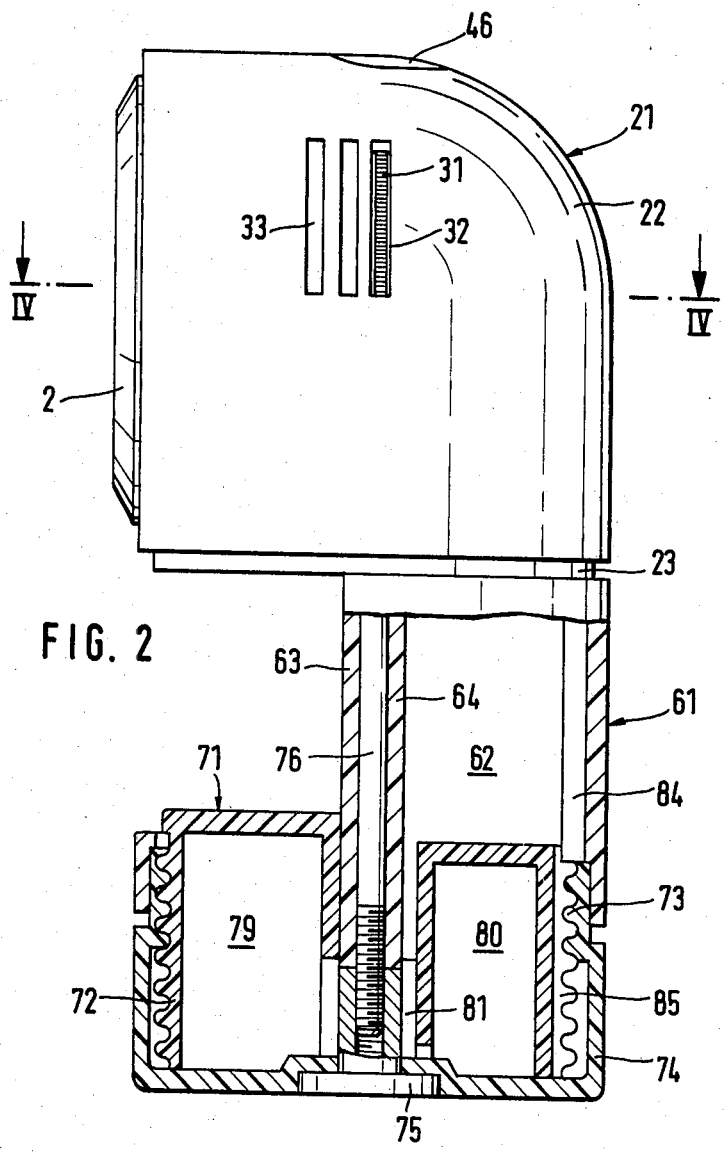
FIG. 2 is a side view partially in section of the clock of FIG. 1.

The clock contains a movement case 1 which contains a quartz clock movement and is closed by a viewing glass 2 on the side thereof facing the viewer. Behind the viewing glass 2 and in front of the dial 3 there are present the seconds hand 4, the minute hand 5, the hour hand 6 and the alarm hand 7. On the side facing away from the viewer there is a compartment 8 for a battery, not shown in detail. On the movement case 1 there are furthermore provided two contact lugs for the battery, only the contact lug 9 being visible. The viewing glass 2 is held by means of a few detent fingers 10 which are uniformly distributed over the periphery of the movement case and engage into corresponding holes 11 in the viewing glass 2.

On the rear of the movement case 1 there is a setting wheel 12 for setting the time of the clock. From the rear wall of the movement case 1 there also extends the setting shaft 13 for the alarm time as well as the start-stop pin 14 for the alarm, the pin when depressed disconnecting the alarm device. In the position of the pin which extends out of the movement case 1, the alarm is connected. On the end of the setting shaft 13 which terminates within the movement case 1 there is seated a pinion 15 by which the setting shaft 13 is in engagement with the alarm wheel (not shown). In order to prevent the alarm wheel from being turned in a direction of rotation which damages the release mechanism, a wrap spring 16 which acts as a ratchet brake is disposed on the shaft 13.

On the rear side of the movement case 1 which is made of plastic there is formed a central tubular extension 17 whose longitudinal axis is concentric to the dial 3. At its free end the extension 17 forms an inner collar 18 behind which a hook 19 of a locking element 20 engages. By means of the locking element 20, the movement case 1 which forms a self-enclosed unit is held detachably in the mount 21.

The mount 21 is developed in the form of a housing which comprises a housing cover 22 and a bottom part 23. Both parts 22 and 23 are injection moldings of plastic. The bottom part 23 carries two hollow posts 25 provided with a hole 24 at their ends, while the housing hood 22 has two corresponding supporting posts (not shown) which, after the insertion of the bottom part 23 into the housing hood 22, rest against the supporting posts 25. In each of these supporting posts of the housing hood 22 there is a threaded bore into which a screw extending through the hole 24 can be threaded, whereby the housing hood 22 and the bottom part 23 are connected together.

Within the housing 21 there is a gear wheel 26 which is supported on the tubular extension 17. The gear wheel 26 is provided with an internal toothing 27 into which there engages a pinion 28 which is seated on the setting arbor 13 of the alarm device. On its outer periphery the gear wheel 26 furthermore bears an outer toothing 29 which meshes with a gear wheel 30 supported in the housing. On this gear wheel 30 there is formed a setting wheel 31, a part of the periphery of which extends out through a slot 32 in the housing hood 22. Alongside the slot 32 are two additional slots 33 which serve as sound-exit openings for the buzzer of the alarm.

The gear wheel 26 is mounted in the housing 21 by means of a collar 34 which extends radially beyond the toothing 29 as well as by a connecting piece 86 formed thereon. This mounting comes into support action when the movement case 1 is removed from the housing 21 and the tubular extension 17 on which the gear wheel 26 is normally mounted is no longer available for its mounting. The mounting is effected by means of two lower supports 35 and 36 both of which are formed on the bottom part 23 and by means of an upper support 37 which is formed on the housing hood 22. Alongside these elements which radially support the gear wheel 26 there are furthermore provided stops 38, 39, 40, 41, 42 respectively which act on the collar 34 and by which the axial movement of the gear wheel 26 is limited.

On its end side facing the movement case 1 the gear wheel 26 is provided with a working surface 43 which cooperates with the start-stop pin 14 of the alarm device. For the axial displacement of the gear wheel 26 against the force of the spring 44 in order to actuate the start-stop pin of the alarm device, the gear wheel 26 is provided with a conically tapered base surface 45 which cooperates with a setting button 46 supported for axial displacement in the housing hood 22. In the depressed position of the setting button 26 shown in the drawing, its actuating extension 47 is at the upper edge of the conical part 45 of the gear wheel, as a result of which the latter is moved in the direction towards the movement case and, via the working surface 43, actuates the start-stop pin 14 of the alarm device in order to disconnect the alarm. In the other position of the setting knob 46 in which the knob extends out of the contour of the housing hood 22, the actuating extension 47 is in an elevated position outside the field of action of the conical part 45 of the gear wheel 26. In this position of the setting knob 46, the gear wheel 26 is in a remote position from the movement case as a result of the restoring force of the spring 44, so that the start-stop pin 14 of the alarm device, due to the switch spring (not shown) which acts on it, can move into the position in which it turns on the alarm device.

The setting knob 46 is provided with an insert 48 having a heart-shaped groove 49 into which a control spring 50 engages. This known heart-shaped cam control together with the compression spring 51 causes the setting knob 46 when depressed to remain in its depressed position and when depressed again to be displaced from the depressed position into a position extending out of the contour of the housing (cf. FIG. 5).

Within the setting knob 46 there is a guide channel 52 for a bolt-shaped extension 53 of the locking element 20. The locking element 20 is furthermore guided in a hole 54 in the bottom part 23. In order to return the locking element 20 into its position of rest shown in the drawing there is provided a spring leg 55 developed on the element which is made of plastic. By depression of bolt 53, for instance by means of a ball-point pen, the hook 19 comes out of engagement with the inner collar 18 and the movement case 1 is ejected from the housing 21 by the spring 44. In order to prevent the movement case 1 being thrown out of the housing 21 when it is released, and dropping to the floor where it may be damaged, it is advisable to develop on the hook 19 a small extension 56, which, when the locking element 20 is depressed, prevents the movement case 1 from being ejected forward in an uncontrolled manner.

As can be seen, the spring 44 performs two functions, namely on the one hand it serves for the ejection of the movement case 1 from the housing 21 and, on the other hand, when the movement case 1 is inserted into the housing 21 it serves to return the gear 26 into its position of rest, in which the alarm device is actuated. In addition to these two functions, the spring 44 can however also perform still a third function. If it is namely developed as wrap spring, the wrap spring 16 can be omitted and the wrapping action of the spring 44 then prevents the gear chain consisting of the gear wheels 15, 28, 26 and 30 from being operated in a direction of revolution in which the alarm wheel could be damaged. The wrap action can be obtained readily in the manner that both the collar 57 on the movement case 1 and the collar 58 on the gear wheel 26 are each provided in peripheral direction with a shoulder against which the end of the spring can rest.

In the bottom part 23 of the housing 21 there is a recess 59 which passes into a slot 60 into which a clamping device 61 can be pushed so that it engages in detachable manner therein.

The clamping device comprises a guide 62 of semicircular cross section on the one straight wall 63 of which a sleeve 64 is developed over its entire length. On the end thereof adjacent the housing 21 the guide 62 passes into a stationary clamping plate 65 in such a manner that the top of the clamping plate 65 is aligned with an elevation 66 on the face side of the guide 62. The clamping plate 65 and the elevation 66 together form a circular surface behind the edge of which two detent springs 67 and 68 developed in the bottom part 23 can engage. As a result of these detent springs 67 and 68 the clamping device remains dependably connected to the housing 21 in every relative position of the housing 21 to the clamping device 62. In order to keep the wear on the clamping plate 65 and the elevation 66 small, a thin metal plate 69 is placed thereon, said plate being widened in the region of the clamping plate and a rubber layer 70 being applied to it and to the clamping plate.

The movable clamping body 71 bears on its outer periphery a thread 72 which cooperates with a corresponding thread 73 on a rotary body 74. This rotary body is rotatably supported in the guide 62. Another support point is formed by a nut 75 which can be screwed onto a threaded bolt 76. The other end of the threaded bolt 76 carries a bushing 77 having a collar 78 by which the clamping device 61 is held in the slot 60.

The clamping body 71 is subdivided into two individual bodies 79 and 80 which are connected with each other by two webs 81 spaced apart from each other, each web extending through a slot 82 and 83 respectively in the wall 63 of the guide 62. As further means to prevent rotation there is provided a rail 84 which is developed in the guide 62 and engages in a corresponding groove 85 in the clamping body 71. By turning the rotary body 64 in the one direction the clamping body 71 is moved towards the clamping plate 65 and by turning the rotary body in the other direction it is moved away from the clamping plate 65. In this way the clock can, for instance, be clamped to a tabletop, the side of a bookcase or some other object. By turning the housing 21 with respect to the clamping device 61 and by turning the movement case 1 in the housing 21 the dial can then be brought into the position of use which is most favorable for the viewer.

I claim:

1. In an electrical clock, particularly a quartz clock, with a movement case receiving a time-producing and time-indicating device, on the rear side of the movement case setting members being provided for the clock time and for an alarm device, and a mount in which the movement case is insertable in different relative positions relative to the mount, the improvement comprising a viewing glass covering the time-indicating device, said movement case with said viewing glass forming a self-contained unit, the mount is formed as a housing surrounding on all sides at least the rear side of the movement case and has an inner periphery which corresponds to the periphery of the movement case, said movement case being detachably catchably insertable within the inner periphery of said housing, attachment means for connection to said housing at the outer periphery of said housing, setting means accessible from an outside of said housing are mounted in said housing, said setting means, when the movement case is inserted in said housing, for being operatively connected, in all relative positions of said movement case in said housing, with the setting member of the alarm device.

2. The electrical clock as set forth in claim 1, further comprising means for receiving said movement case in said housing, a setting shaft protruding from said movement case and constituting means for setting the alarm time, a pinion is mounted on an end of said setting shaft, a gear wheel having an inner toothing meshing with said pinion and an outer toothing, said gear wheel is mounted in said housing concentrically to said means for receiving said movement case, a setting wheel constituting one of said setting members projecting beyond an outer periphery of the housing and is operatively connected with the outer toothing of said gear wheel.

3. The electrical clock as set forth in claim 1, wherein one of said setting members constitutes a setting button axially displaceably mounted in said housing from a first position into a second position, said alarm device includes a start-stop pin projecting from said movement case, a wedge transmission means for operatively connecting said setting button with said start-stop pin of the alarm device.

4. The electrical clock as set forth in claim 3, further comprising gear wheel means disposed in the housing for setting of the alarm time, spring means for basing said gear wheel means, the latter is axially displaceably mounted against the force of said spring means and forming a part of said wedge transmission means, said part is operatively connected with said alarm device.

5. The electrical clock as set forth in claim 4, wherein said gear wheel means has a face which is at least partially conical in cross section, said face constitutes said part of said wedge transmission means and cooperates with a free end of said setting button.

6. The electrical clock as set forth in claim 2, wherein said gear wheel is mounted at its outer periphery in the housing.

7. The electrical clock as set forth in claim 6, wherein said housing includes two housing parts, the gear wheel has a collar which extends radially beyond said outer toothing, and said collar is rotatably mounted between said two housing parts.

8. The electrical clock as set forth in claim 2, wherein said movement case is formed on a rear thereof with a central tubular extension having an inner collar on an end thereof, said gear wheel is formed with central opening, said tubular extension extends through said central opening in the gear wheel, a locking element displaceably mounted in said housing, a restoring spring for biasing said locking element, said locking element is formed with a hook, said hook extends into said tubular extension and engages behind said inner collar.

9. The electrical clock as set forth in claim 8, wherein one of said setting members constitutes a setting button axially displaceably mounted in said housing from a first position into a second position, said alarm device includes a start-stop pin projecting from said movement case, a wedge transmission means for operatively connecting said setting button with the start-stop pin of the alarm device, said locking element is mounted coaxially in said setting button displaceable independently relative thereto and terminates below an operating movement stroke of said setting button in such a manner that upon actuation of said setting button, said locking element remains unactuated.

10. The electrical clock according to claim 8, further comprising a compression spring disposed between said tubular extension and said gear wheel, said compression spring is supported on said gear wheel and said extension and constitutes means for exerting an ejection action between said toothed gear wheel and said extension.

11. The electrical clock according to claim 8, wherein said restoring spring is formed on said locking element.

12. The electrical clock according to claim 8, further comprising an extension means formed on a rear-side end area of said hook for cooperating with said inner collar during ejection of said movement case after said hook is released to prevent complete ejection.

13. The electrical clock as set forth in claim 1, wherein the outer periphery of said movement case and said inner periphery of said housing are formed with notches and projections, respectively, said notches and projections engaging with each other when the movement case is inserted in said housing.

14. The electrical clock as set forth in claim 1, wherein one side of the housing is formed as a base having an opening, a clamping device is releasably snap-catchingly with said base insertable into said opening and capable of turning relative to the housing.

15. The electrical clock as set forth in claim 14, wherein said clamping device comprises, a fixed clamping plate, and a guide secured to said clamping plate, a moveable clamping body mounted longitudinally displaceably but non-rotatably on said guide, said clamping body is formed on its outer periphery with a thread, a rotary body rotatably mounted on said guide has a thread cooperating with said first-mentioned thread of said clamping body.

16. The electrical clock as set forth in claim 15, wherein said guide comprises, a tubular part having a wall formed with two slots parallel to each other, adapted to guide said movable clamping body and a rail which is axially parallel to a guide path, said clamping body is formed with a recess, said rail engages in said recess for non-rotatably mounting said clamping body, means for mounting said rotary body.

17. The electrical clock as set forth in claim 16, further comprising a sleeve on an inner wall of said tubular part, a threaded bolt extends through said sleeve and has a head means for insertion by releasable snap-catch engagement into said opening in the base of the housing, a shaft nut capable of being screwed onto a free end of said threaded bolt and resting against an end of said sleeve and for rotatably mounting said rotary body.

18. The electrical clock as set forth in claim 1, wherein said self-contained unit is of polygonal contour.

19. The electrical clock as set forth in claim 1, wherein said self-contained unit is of circular contour.

* * * * *